US007487962B2

(12) United States Patent
Shibahara

(10) Patent No.: US 7,487,962 B2
(45) Date of Patent: Feb. 10, 2009

(54) SHEET FEEDING DEVICE AND IMAGE FORMING APPARATUS

(75) Inventor: Masami Shibahara, Nabari (JP)

(73) Assignee: Kyocera Mita Corporation, Osaka (JP)

( * ) Notice: Subject to any disclaimer, the term of this patent is extended or adjusted under 35 U.S.C. 154(b) by 263 days.

(21) Appl. No.: 11/412,683

(22) Filed: Apr. 27, 2006

(65) Prior Publication Data

US 2006/0244195 A1 Nov. 2, 2006

(30) Foreign Application Priority Data

Apr. 28, 2005 (JP) ..... 2005-131919

(51) Int. Cl.
*B65H 1/30* (2006.01)

(52) U.S. Cl. ..... 271/162; 271/157

(58) Field of Classification Search ..... 271/147, 271/162, 157
See application file for complete search history.

(56) References Cited

FOREIGN PATENT DOCUMENTS

JP 04213552 A * 8/1992
JP H6-144643 5/1994

* cited by examiner

*Primary Examiner*—Kaitlin S Joerger
(74) *Attorney, Agent, or Firm*—Ditthavong Mori & Steiner, P.C.

(57) ABSTRACT

When the setting of sheet P is completed, a lift motor is actuated to raise the sheet P at Speed A×2. When a first light-blocking plate raised in association with the rise of the sheet P is detected by a PI sensor, the lift motor reduces its rotational speed to switch its lifting speed from high Speed A×2 to Speed A which is a half of the high speed. The Speed A does not cause the lift motor to overrun.

20 Claims, 4 Drawing Sheets

SHEET FEEDING DEVICE AND IMAGE FORMING APPARATUS

BACKGROUND OF THE INVENTION

1. Field of the Invention

This invention relates to a sheet feeding device and image forming apparatus, and in particular, relates to the sheet feeding device and image forming apparatus including a unit for raising sheets of paper to be fed through the use of a lift motor and other elements.

2. Description of Related Art

In conventional sheet feeding devices, a lifting unit such as a lift motor is generally used to raise sheets of paper to an optimal feeding position according to the quantity of paper.

A sheet feeding device that detects the residual quantity of paper by means of an elevation drive mechanism is disclosed in Japanese unexamined patent publication No. 06-144643, for example.

According to JP 06-144643, a marker detecting sensor senses a sheet residual quantity detecting marker provided on an elevating path to detect the residual quantity of paper. Consequently, the sheets of paper are moved up to the optimal position based on the quantity of paper.

However, according to JP 06-144643, when the residual quantity of paper to be fed is small, it takes some time to elevate the paper. It would be possible to decrease time by raising the paper at high speed, however, excessively high speed may cause the lift motor or other elements to overrun, thereby creating the possibility for the sheets of paper not to stop at the optimal feeding position.

BRIEF SUMMARY OF THE INVENTION

An object of the present invention is to provide a sheet feeding device and image forming apparatus capable of reducing the time required to raise sheets of paper as well as stopping the sheets at an optimal feeding position.

The sheet feeding device according to the present invention includes a sheet lifting unit for raising the sheets of paper to be fed. The sheet lifting unit has a first lifting unit for raising the sheets at a first speed, a second lifting unit for raising the sheets at a second speed which is faster than the first speed. The sheet feeding device also includes a lifting speed switching unit for actuating the second lifting unit so as to raise the sheets up to a predetermined position and actuating the first lifting unit so as to raise the sheets after the arrival of the sheets at the predetermined position.

When the sheets of paper are raised according to the present invention, the sheets can be raised at high speed until reaching the predetermined position and raised at low speed from the predetermined position, thereby eliminating the risk of overrun of the lift motor or other elements.

As a result, the sheet feeding device and image forming apparatus capable of reducing the time required to raise the sheets as well as stopping the sheets at the optimal feeding position can be provided.

Preferably, the lifting speed switching unit has a sheet position sensing unit for detection of the sheets having reached the predetermined position.

More preferably, the sheet position sensing unit has a first light-blocking plate and a second light-blocking plate that are raised in association with the sheet lifting unit, and detects that the sheets have reached the predetermined position by sensing the first light-blocking plate while stopping the sheets by sensing the second light-blocking plate.

The image forming apparatus according to the present invention includes any one of the above-described sheet feeding devices.

DETAILED DESCRIPTION OF THE PREFERRED EMBODIMENT

Figure 1:
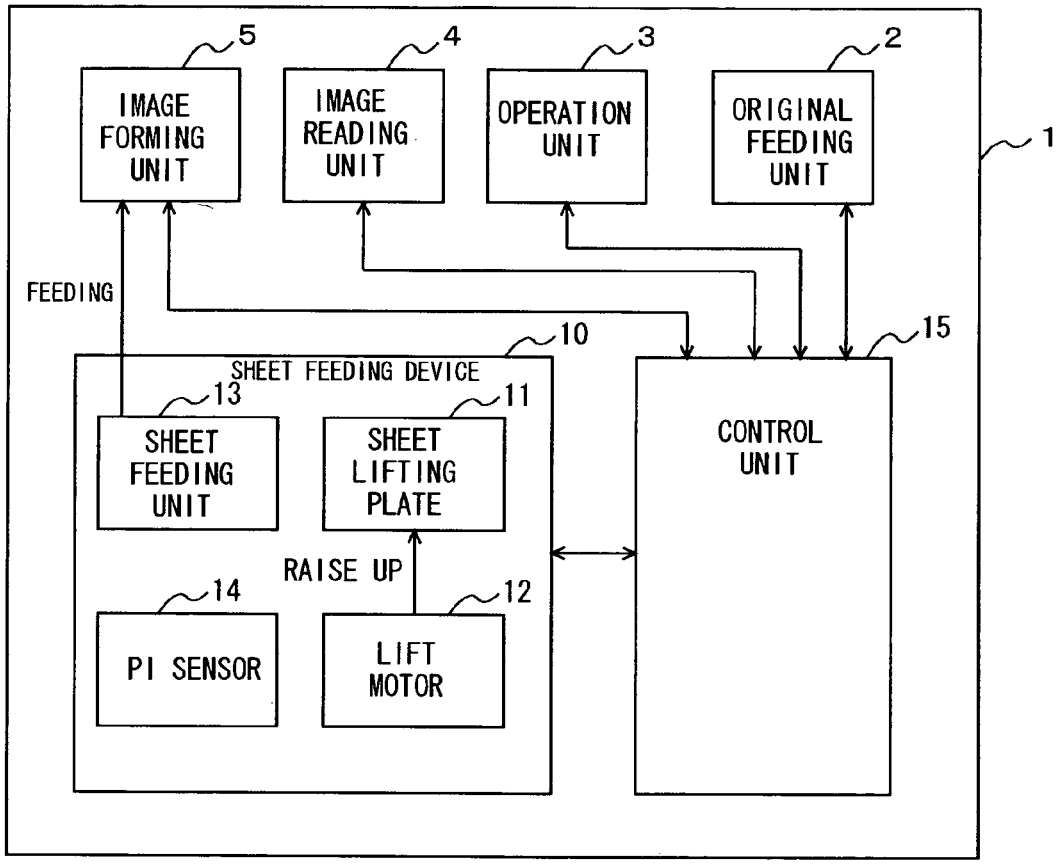
FIG. 1 is a block diagram illustrating the structure of a sheet feeding device and image forming apparatus according to an embodiment of the present invention.

Referring to the drawings, an embodiment of the present invention will be described below. FIG. 1 is a block diagram illustrating the structure of the sheet feeding device and image forming apparatus according to the embodiment of the present invention. With reference to FIG. 1, the image forming apparatus 1 includes an operation unit 3 that is an interface through which users operate the image forming apparatus 1, an original feeding device 2 that automatically transfers an original document to a predetermined position at which images on the original are read, an image reading unit 4 in which a scanner reads images on the original, which is transferred by the original feeding device 2, at the predetermined reading position, an image forming unit 5 that forms the images read from the original document through the use of the image reading unit 4, a sheet feeding device 10 that feeds sheets of paper to the image forming unit 5, and a control unit 15 that controls the operation of the sheet feeding device 10 and the entire image forming apparatus 1.

The sheet feeding device 10 includes a sheet lifting plate 11 on which sheets of paper are placed, a lift motor 12 that acts as a sheet lifting unit to raise the sheet lifting plate 11, a sheet feeding unit 13 that feeds the raised sheets to the image forming unit 5, and a PI (Photo Interrupter) sensor 14 that is fixed at a part of the sheet feeding device 10 and senses a first light-blocking plate and a second light-blocking plate which will be described later.

The lift motor 12 can provide a second speed for raising the sheets relatively fast and a first speed for raising the sheets relatively slowly.

These lifting speeds are switchable by changing the rotational speed of the motor. Hereinafter, the first speed is defined as Speed A, while the second speed is defined as Speed A×2 which is twice as fast as the first speed.

Figure 2:
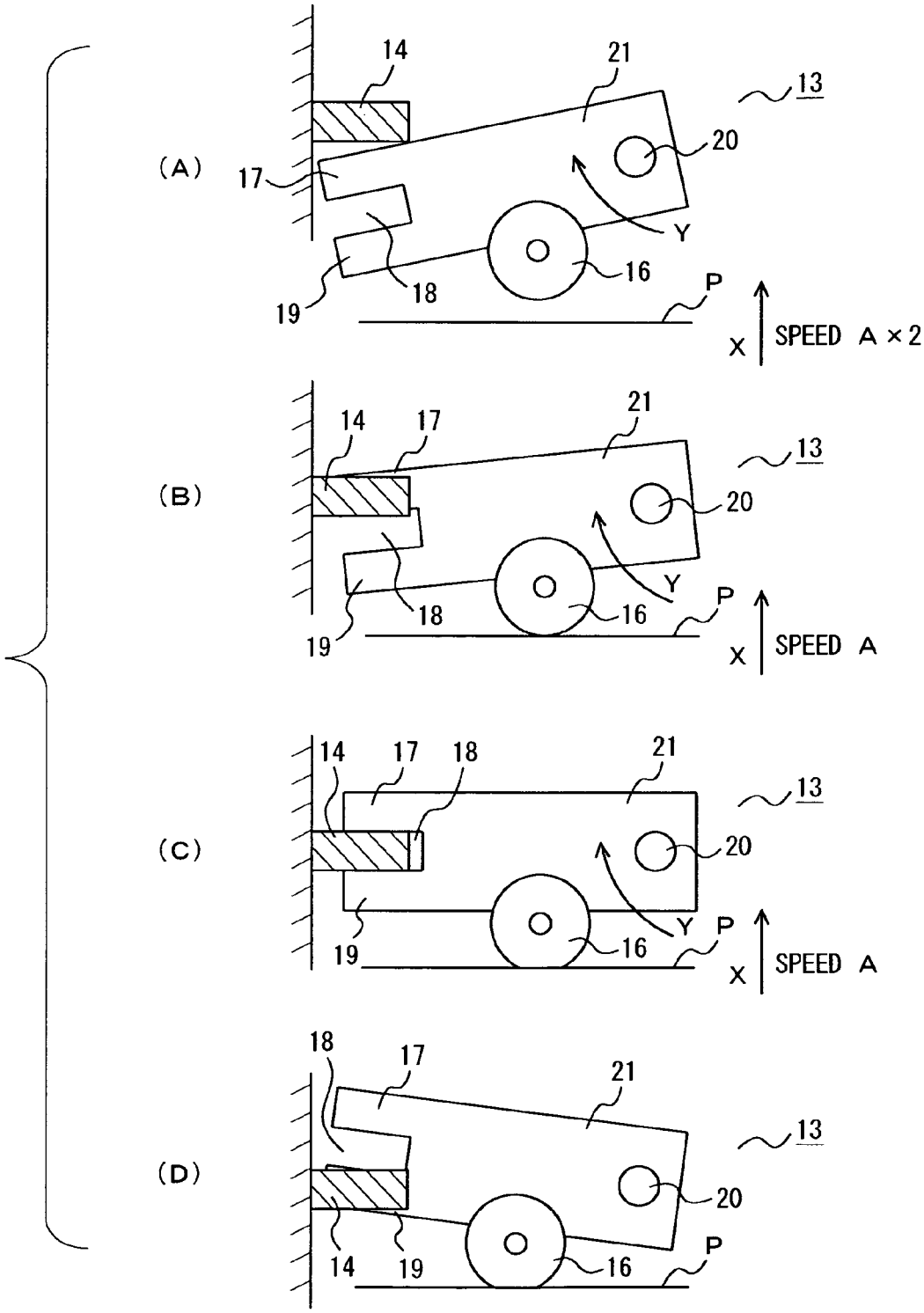
FIG. 2 illustrates the operation of a sheet feeding unit when sheets of paper are raised up to an optimal feeding position.

FIG. 2 is a schematic view illustrating the operation of the sheet feeding unit 13 when the sheets are raised up to the optimal feeding position. With reference to FIG. 2A, the sheet feeding unit 13 includes a paper feed roller 16 and a plate 21. The paper feed roller 16 is attached to the lower part of the plate 21 and constructed to abut the top surface of a sheet of paper P when the sheet P is raised. The plate 21 is provided with a fulcrum 20 which is supported on a side (not shown) of the sheet feeding unit 13. The plate 21 can rotate in the direction of arrow Y about the fulcrum 20 in association with the rise of the sheet P. On the opposite end of the plate 21 to the fulcrum 20, provided are a first light-blocking plate 17 and second light-blocking plate 19. The first and second light-blocking plates 17 and 19 are arranged on the upper part and lower part of the plate 21, respectively. A slit 18 is formed between the first light-blocking plate 17 and second light-blocking plate 19. In other words, the first and second light-blocking plates 17 and 19 can be formed only by providing the slit 18 in the plate 21.

Figure 3:
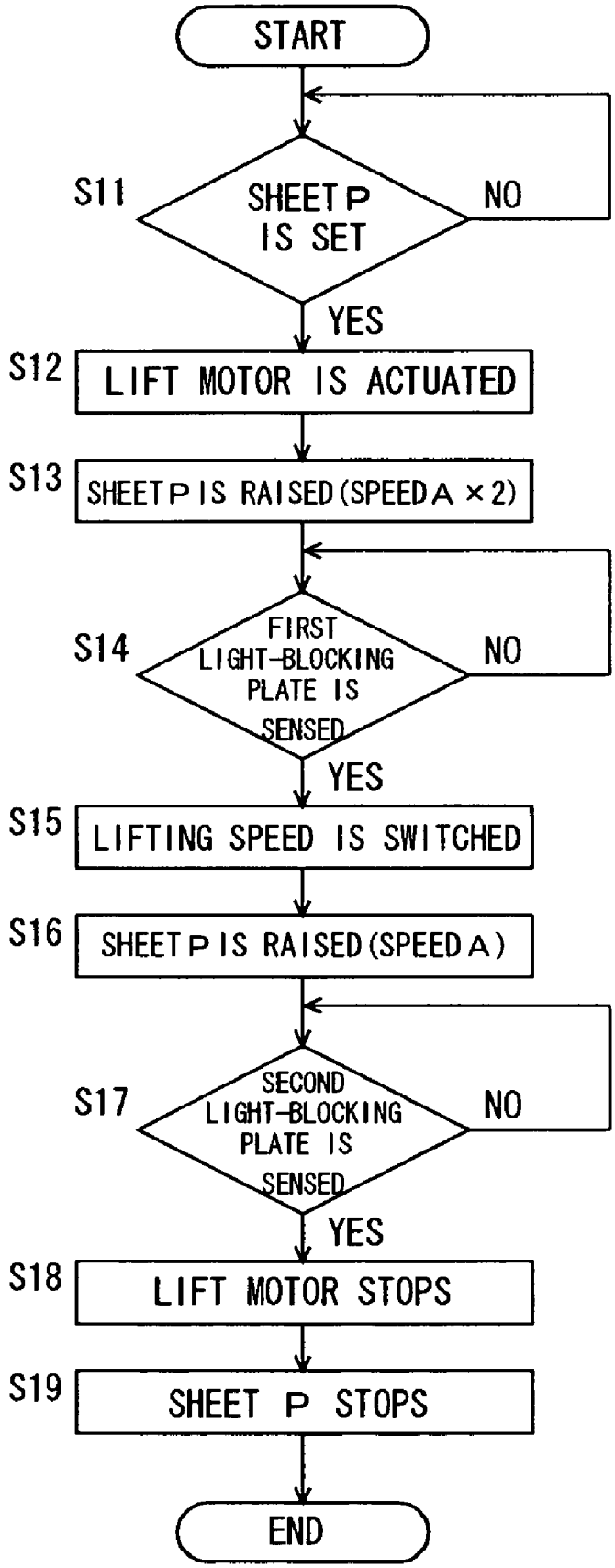
FIG. 3 is a flow chart illustrating the operation of a control unit when the sheets are raised up to the optimal feeding position.
Figure 4:
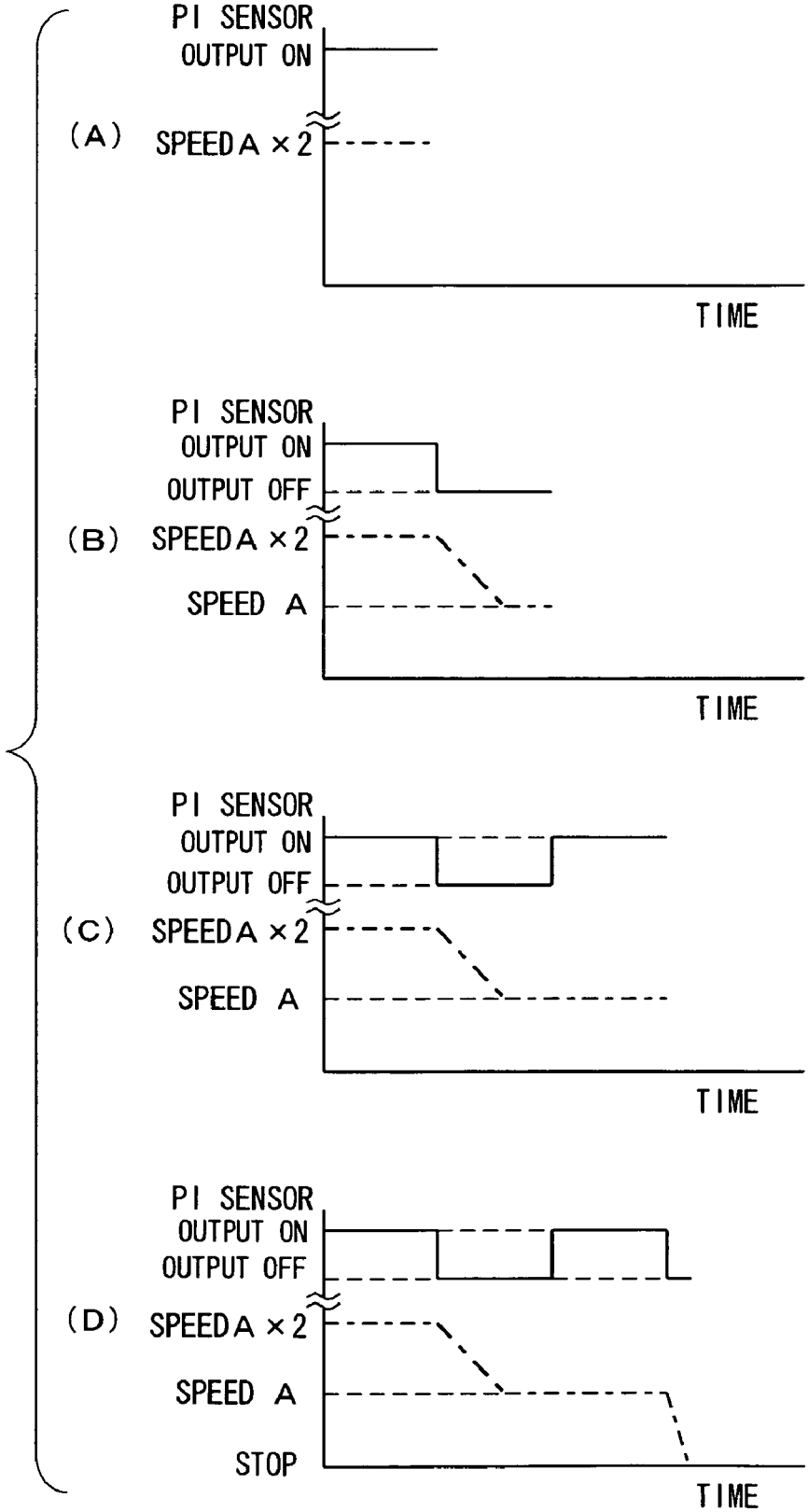
FIG. 4 illustrates outputs of a PI sensor and sheet lifting speeds when the sheets are raised up to the optimal feeding position.

FIG. 3 is a flow chart illustrating the operation of the control unit 15 when the sheet P is raised up to the optimal feeding position by using the sheet feeding device according to the embodiment of the present invention. FIG. 4 illustrates the outputs of the PI sensor 14 and lifting speeds of the sheet P. With reference to FIGS. 2 to 4, a description will be made on the operation when the sheet P is raised up to the optimal feeding position. In FIG. 4, solid lines represent the outputs of the PI sensor 14 while the dashed lines represent the lifting speeds of the sheet P.

First, the sheet P is placed on the sheet lifting plate 11 and set (Step S11 in FIG. 3, hereinafter "Step" is omitted). When the setting of the sheet P is completed, the lift motor 12 is actuated (S12) to raise the sheet P in the direction of arrow X at Speed A×2 (S13, FIGS. 2A and 4A). At this time, the lift motor 12 acts as a second lifting unit. The output of the PI sensor 14 is ON.

Once the top surface of the sheet P abuts the paper feed roller 16, the sheet P starts pushing up the paper feed roller 16. The plate 21, operatively associating with the push-up action, then starts rotating about the fulcrum 20 in the direction of arrow Y. The first light-blocking plate 17 is sensed by the PI sensor 14 at this point (S14, FIGS. 2B and 4B). The output of the PI sensor 14 changes to OFF. With this output change of the PI sensor 14 from ON to OFF, the control unit 15 detects that the sheet P has reached the predetermined position. The PI sensor 14 and control unit 15 now act as a sheet position sensing unit.

With the detection of the sheet P having reached at the predetermined position, the lift motor 12 reduces its rotational speed to switch its lifting speed from Speed A×2 to Speed A (S15). The control unit 15 now acts as a lifting speed switching unit.

After the switching of the lifting speed is done, the sheet P is raised in the direction of arrow X at Speed A (S16). The lift motor 12 now acts as a first lifting unit. In association with the rise of the sheet P, the plate 21 further rotates in the direction of arrow Y, causing the first light-blocking plate 17 to go off the detection range of the PI sensor 14. Subsequently, the slit 18, which is arranged under the first light-blocking plate 17, comes into the detection range of the PI sensor 14. Again, the output of the PI sensor 14 turns ON (FIGS. 2C and 4C).

When the sheet P is raised up further, the slit 18 goes off the detection range of the PI sensor 14. Then, the second light-blocking plate 19 arranged under the slit 18 is sensed by the PI sensor 14 (S17, FIGS. 2D and 4D). Again, the output of the PI sensor 14 changes to OFF. With this output change of the PI sensor 14 from ON to OFF again, the lift motor 12 stops so as to make the sheet P stop at the optimal feeding position (S 18 and S19).

In this manner, upon raising sheets of paper, a high-speed ascent can be made until the sheets reach the predetermined position. In addition, an ascent at a half of the high speed from the predetermined position eliminates the possibility for the sheet lifting plate to overrun.

As a result, it is possible to provide a sheet feeding device and image forming apparatus capable of reducing the time required to raise the sheets as well as stopping the sheet at the optimal feeding position.

Although the lifting speeds are switched over upon the detection of the sheet having reached the predetermined position in the above-described embodiment, the present invention is not limited to this. Users may choose and set timing to switch over the lifting speeds. For example, the timing can be set so that the lifting speeds are switched over after a lapse of a few seconds or after counting the predetermined number of the sheets subsequent to the detection of the first light-blocking plate by the PI sensor.

In this manner, the time required to raise the sheets can be optimized according to the motor performance and user's needs.

Although the fact that the sheets have reached the predetermined position is detected by sensing the first light-blocking plate by using the PI sensor in the above-described embodiment, the present invention is not limited to this. It is also possible to detect the sheets having reached the predetermined position by using the other sensor or on the basis of the period of driving time of the motor.

Although the above-described embodiment provides two switchable speeds, a low speed and a high speed which is twice as fast as the slow speed, for raising the sheets, the present invention is not limited to this.

Depending on the motor performance, the speed for raising the sheets may be set. For example, the high speed may be twice or more as fast as the slow speed. There also may be provided, not limited to two speeds, but multiple speeds which are switchable to raise the sheets. Thus, the lifting speeds can be set in a more optimal way.

In addition, the present invention is not limited to the above-described embodiment in which the control unit, which controls the entire image forming apparatus, is used to control the operation of the sheet feeding device. A control unit may be provided in the sheet feeding device.

The foregoing has described the embodiment of the present invention by referring to the drawings. However the invention should not be limited to the illustrated embodiment. It should be appreciated that various modifications and changes can be made to the illustrated embodiment within the scope of the appended claims and their equivalents.

What is claimed is:

1. A sheet feeding device comprising:

a sheet lifting unit for raising sheets of paper to be fed, the sheet lifting unit being configured to raise the sheets from a first position to a second position at a first speed and from the second position to a sheet feeding position at a second speed being slower than the first speed;

a movable sheet feeding unit having a paper feed roller configured to feed the sheet of paper at the sheet feeding position; and a lifting speed switching unit for actuating and controlling the speed of the sheet lifting unit to raise the sheets from the first position to the sheet feeding position, the lifting speed switching unit being configured to control the speed of the sheet lifting unit based on movement of the movable sheet feeding unit due to contact between the paper feed roller and the sheet of paper on the sheet lifting unit.

2. The sheet feeding device according to claim 1, wherein the lifting speed switching unit comprises a sheet position sensing unit for detecting that the sheets have reached the second position.

3. The sheet feeding device according to claim 2, wherein the movable sheet feeding unit comprises a first light-blocking plate and a second light-blocking plate being raised in association with the sheet lifting unit, and wherein the sheet position sensing unit detects that the sheets have reached the second position by sensing the first light-blocking plate and stops raising the sheets by sensing the second light-blocking plate.

4. An image forming apparatus including the sheet feeding device according to claim 1.

5. The sheet feeding device according to claim 1, wherein the paper feed roller is configured to be contacted by the sheet of paper on the sheet lifting unit as the sheet lifting unit raises the sheet of paper from the first position to the second position, and wherein the paper feed roller is configured to be in contact with the sheet of paper on the sheet lifting unit as the sheet lifting unit raises the sheet of paper from the second position to the sheet feeding position.

6. The sheet feeding device according to claim 1, wherein the paper feed roller is configured to contact the sheet of paper on said the lifting unit before the sheet lifting unit raises the sheet of paper to the second position.

7. The sheet feeding device according to claim 1, wherein, during a portion of a path of travel between the first position and the second position, the paper feed roller is configured to not be in contact with the sheet of paper on the sheet lifting unit, and wherein, during the portion of the path of travel, the movable sheet feeding unit does not move when the sheet lifting unit is raising the sheet of paper.

8. The sheet feeding device according to claim 1, wherein the sheet feeding unit is pivotally movable.

9. The sheet feeding device according to claim 1, wherein the sheet lifting unit is configured to raise the sheet of paper continuously from the first position to the sheet feeding position.

10. The sheet feeding device according to claim 1, wherein the sensor is a photo interrupter sensor.

11. A sheet feeding device comprising:

a sheet lifting unit configured to raise a sheet of paper from a first position to a second position at a first speed, said sheet lifting unit being configured to raise the sheet of paper from the second position to a sheet feeding position at a second speed that is slower than the first speed;

a movable sheet feeding unit having a paper feed roller configured to feed the sheet of paper at the sheet feeding position, said movable sheet feeding unit being configured to move due to contact between said paper feed roller and the sheet of paper on said sheet lifting unit as said sheet lifting unit raises the sheet of paper from the first position to the sheet feeding position; and a sensor configured to sense movement of said movable sheet feeding unit in order to output a signal, said signal being used to control the speed of said sheet lifting unit.

12. The sheet feeding device according to claim 11, wherein said paper feed roller is configured to come into contact with the sheet of paper on said sheet lifting unit as said sheet lifting unit raises the sheet of paper from the first position to the second position, and said paper feed roller being configured to be in contact with the sheet of paper on said sheet lifting unit as said sheet lifting unit raises the sheet of paper from the second position to the sheet feeding position.

13. The sheet feeding device according to claim 11, wherein said paper feed roller is configured to contact the sheet of paper on said sheet lifting unit before said sheet lifting unit raises the sheet of paper to the second position.

14. The sheet feeding device according to claim 11, wherein, during a portion of a path of travel between the first position and the second position, said paper feed roller is configured to not be in contact with the sheet of paper on said sheet lifting unit, and wherein, during said portion of said path of travel, said movable sheet feeding unit does not move when said sheet lifting unit is raising the sheet of paper.

15. The sheet feeding device according to claim 11, wherein said sheet feeding unit is pivotally movable.

16. The sheet feeding device according to claim 11, wherein said sheet lifting unit is configured to raise the sheet of paper continuously from the first position to the sheet feeding position.

17. The sheet feeding device according to claim 11, wherein said sensor is a photo interrupter sensor, and wherein said movable sheet feeding unit has a first light-blocking member and a second light-blocking member.

18. The sheet feeding device according to claim 17, wherein said sensor outputs a first signal when said sensor senses said first light-blocking member, and wherein said sensor outputs a second signal when said sensor senses said second light-blocking member.

19. The sheet feeding device according to claim 18, wherein said sheet lifting unit changes from the first speed to the second speed when the sensor outputs the first signal, and wherein said sheet lifting unit stops the sheet of paper at the sheet feeding position when the sensor outputs the second signal.

20. The sheet feeding device according to claim 19, wherein said sheet lifting unit raises the sheet of paper at the first speed prior to said sensor outputting the first signal.

* * * * *